US010674567B2

(12) United States Patent
Schossig et al.

(10) Patent No.: US 10,674,567 B2
(45) Date of Patent: Jun. 2, 2020

(54) MICRO-HEATING CONDUCTOR

(71) Applicant: INFRASOLID GMBH, Dresden (DE)

(72) Inventors: Marco Schossig, Dresden (DE); Tobias Ott, Dresden (DE)

(73) Assignee: INFRASOLID GMBH, Dresden (DE)

( * ) Notice: Subject to any disclaimer, the term of this patent is extended or adjusted under 35 U.S.C. 154(b) by 0 days.

(21) Appl. No.: 16/319,427

(22) PCT Filed: Jul. 26, 2017

(86) PCT No.: PCT/EP2017/068942
§ 371 (c)(1),
(2) Date: Jan. 21, 2019

(87) PCT Pub. No.: WO2018/019915
PCT Pub. Date: Feb. 1, 2018

(65) Prior Publication Data

US 2019/0281665 A1 Sep. 12, 2019

(30) Foreign Application Priority Data

Jul. 26, 2016 (DE) ..... 10 2016 113 747

(51) Int. Cl.
*H05B 3/16* (2006.01)
*H05B 3/28* (2006.01)

(52) U.S. Cl.
CPC ..... *H05B 3/28* (2013.01); *H05B 3/16* (2013.01); *H05B 2203/003* (2013.01); *H05B 2203/007* (2013.01); *H05B 2203/032* (2013.01)

(58) Field of Classification Search
USPC ..... 392/407, 425, 428, 432, 433, 434, 435, 392/437, 438, 440; 219/209, 228, 254,
(Continued)

(56) References Cited

U.S. PATENT DOCUMENTS 3,099,540 A * 7/1963 Eisler ..... H05B 3/26 34/245
3,523,542 A * 8/1970 Eisler ..... A45D 4/12 132/229

(Continued)

FOREIGN PATENT DOCUMENTS

DE 1295110 A 5/1969
DE 3544499 C1 8/1987

(Continued)

OTHER PUBLICATIONS

International Search Report issued in PCT/EP2017/068942 dated Oct. 11, 2017.

(Continued)

*Primary Examiner* — Tu B Hoang
*Assistant Examiner* — Masahiko Muranami
(74) *Attorney, Agent, or Firm* — Heslin Rothenberg Farley and Mesiti PC; Nicholas Mesiti

(57) ABSTRACT

The invention relates to a micro-heating conductor for a radiation source, wherein the micro-heating conductor is formed from a meandering heating conductor structure which has meandering protrusions and spans a heating conductor structure plane with a surface normal, wherein adjacent meandering protrusions are formed in the heating conductor structure plane and so as to face away from one another in opposite directions. The object of specifying a heating conductor geometry which avoids the disadvantages of the prior art and can be integrated into compact infrared spectroscopic devices is achieved in that the micro-heating conductor comprises at least two heating conductor structures, wherein the heating conductor structures are arranged next to one another, wherein a surface normal of a heating conductor structure plane of a first heating conductor structure encloses an angle α with a surface normal of a second heating conductor structure plane of a second heating con- (Continued)

ductor structure and at least two meandering protrusions of the first heating conductor structure are connected to at least two meandering protrusions of the second heating conductor structure and are designed in an electrically interconnected manner, wherein the micro-heating conductor has a homogeneous thickness.

21 Claims, 11 Drawing Sheets

(58) Field of Classification Search
USPC ..... 219/255, 256, 395, 396, 409, 410, 417, 219/422, 424, 426, 427, 428, 453.13, 219/453.15, 461.1, 466.1, 467.1, 468.1, 219/525, 535, 536, 537, 538, 539, 541, 219/542, 543, 546, 552, 553
See application file for complete search history.

(56) References Cited

U.S. PATENT DOCUMENTS 3,573,430 A * 4/1971 Eisler ..... B65D 81/3476 219/385
3,721,800 A * 3/1973 Eisler ..... F24D 13/02 219/213
4,136,274 A * 1/1979 Shibata ..... B41J 2/3351 219/543
4,883,947 A * 11/1989 Murase ..... G01N 27/4067 219/553
5,034,721 A * 7/1991 Benedictus ..... H05B 3/16 219/552
5,692,291 A * 12/1997 Deevi ..... A24F 47/008 29/611
5,756,215 A * 5/1998 Sawamura ..... C04B 35/117 219/541
5,939,726 A 8/1999 Wood
2002/0108943 A1* 8/2002 Chen ..... H05B 3/50 219/530
2004/0100131 A1* 5/2004 Howick ..... B60N 2/5678 297/180.12
2015/0136756 A1* 5/2015 Vissa ..... H05B 3/24 219/541
2015/0223639 A1* 8/2015 Hou ..... A47J 37/0786 99/401
2015/0329211 A1* 11/2015 Calder ..... B64D 15/14 244/134 D

FOREIGN PATENT DOCUMENTS

DE 10052345 A1 5/2002
DE 102004024044 A1 11/2005
DE 102004046705 A1 3/2006
DE 102005054611 A1 5/2006
DE 102009031890 A1 1/2011
DE 102012103662 B3 4/2013
EP 2434195 A1 3/2012
WO 2013120767 A1 8/2013

OTHER PUBLICATIONS

Marco Schossig et al., "Efficient thermal infrared emitter with high radiant power," AMA Conferences 2015—Sensor 2015, IRS2015/3.4, pp. 934-937.
Written Opinion of the International Searching Authority for International Application No. PCT/EP2017/068942 dated Nov. 10, 2017.

* cited by examiner a) $(n = 3)$ b) (curved)

MICRO-HEATING CONDUCTOR

CROSS REFERENCE TO RELATED APPLICATIONS

This application is the National Phase filing under 35 U.S.C. § 371 of International Application No.: PCT/EP2017/068942, filed on Jul. 26, 2017, and published on Feb. 1, 2018 as WO 2018/019915 A1, and claims priority to German Application No.: 10 2016 113 747.2, filed on Jul. 26, 2016. The contents of each of the prior applications are hereby incorporated by reference herein in their entirety.

The invention relates to a micro-heating conductor, wherein the micro-heating conductor is formed from a meandering heating conductor structure which has meandering protrusions and spans a heating conductor structure plane with a surface normal, wherein adjacent meandering protrusions are formed in the heating conductor structure plane and facing away from one another in opposite directions.

The invention also relates to a micro-heating conductor which is used as a radiation source, such as an infrared radiation source.

BACKGROUND ART

An ideal thermal radiator, a so-called blackbody radiator, emits the maximum amount of energy physically possible at every wavelength λ. The spectral, i.e., wavelength-dependent, specific emission of such a blackbody radiator is described by Planck's radiation law. In thermal infrared radiation sources, the broadband radiant power emitted from a radiating area A is of interest, which is obtained by integration of Planck's radiation law over all wavelengths. The equation $$Ps=\sigma AT^4,$$

applies for this radiant power Ps, which is known as the Stefan-Boltzmann law of the black body radiator and in which σ denotes the Stefan-Boltzmann constant.

Real radiators are not blackbody radiators. The emitted radiant power thereof is less than that of the blackbody radiator of equal radiating area A and temperature T. This is because the real thermal radiator does not emit the maximum possible amount of energy at every wavelength λ. The ratio of real emitted amount of energy and maximum amount of energy which can be emitted is referred to as the emissivity E, which is in the range between zero and one. The emissivity of a blackbody radiator therefore has the value of one and is wavelength-independent. The emissivity of a real radiator, in contrast, is wavelength-dependent and is less than one.

The emitted radiant power of real radiators is furthermore reduced in comparison to blackbody radiators in that the radiating area A is not heated through homogeneously at the temperature T, since the heating element is generally fastened on a colder point, for example, on the housing, and this connection dissipates thermal energy from the heating element to the housing as a result of heat conduction. In addition, heat is dissipated via the surrounding gas. A temperature distribution T(A) thus forms on the area A, wherein areas having a maximum and a minimum temperature form on the radiating area. As a result, the emitted radiant power is therefore dependent on the mean temperature of the area A, which results from the arithmetic mean of the temperature distribution T(A).

The radiant power PrS of a real thermal radiator may therefore be described by an adapted Stefan-Boltzmann law $$P_{rS}=\sigma\bar{\varepsilon}A\bar{T}^4$$

wherein $\bar{\varepsilon}$ represents the arithmetic mean over the wavelength-dependent emissivity ε(A)

$$\bar{\varepsilon} = \frac{1}{\lambda}\int_{\lambda} \varepsilon(\lambda)d\lambda$$

and $\bar{T}$ represents the arithmetic mean of the temperature distribution T(A) on the radiating area A $$\bar{T} = \frac{1}{A}\int_{A} T(A)dA$$

The radiant power is accordingly dependent on the fourth power of the mean temperature $\bar{T}$ and is directly proportional to the mean emissivity $\bar{\varepsilon}$ and the radiating area A. For a high radiant power, the radiating element accordingly has to have a high temperature and a high mean emissivity, which is as close as possible to one. In addition, a large radiating area A having homogeneous temperature distribution is necessary for a high radiant power. Many technical solutions exist for enhancing the emissivity, as described, for example, in the document DE 102012103662 B3.

All thermal radiators function according to the principle of Joule heating or also ohmic heating, i.e., when an electric current flows through a heating conductor, the electrical resistance of the heating conductor works against the current flow, whereby heat is generated. The heat thus resulting heats the heating conductor and is emitted from it via thermal radiation and heat conduction to the housing and/or to the surrounding gas. The heating conductor of an energy-efficient infrared radiator having high radiation yield emits a majority of the electrical energy generated by the applied voltage as thermal radiation again and therefore has to be designed so that the power loss as a result of the heat dissipation to the housing and/or to the surrounding gas is as small as possible.

The heat dissipation to the gas surrounding the radiating heating element or the radiating heating conductor, respectively, can be reduced by filling the housing of the infrared radiation source with an inert gas (for example, argon) and closing it gas-tight. Inert gases are distinguished by a substantially lower heat conductivity than that of air. The heat dissipation of a freestanding heating conductor to the housing of the infrared radiation source can be reduced by enhancing the heat resistance of the heating conductor. The heat resistance of a heating conductor is dependent on the material and its geometry. For typical heating conductor materials, for example, metals, it is proportional to the electrical resistance. A high electrical resistance is also to be considered very advantageous in circuitry, since, according to Ohm's law, lower currents flow in the case of an electrical voltage applied to the heating conductor than in the case of heating conductors having lower electrical resistance. It is described in Ott, T., et al: Efficient thermal infrared emitter with high radiant power, J. Sens. Sens Syst., 4, 313-319, doi:10.5194/jsss-4-313-2015, 2015 that an energy-efficient infrared radiation source has a freestanding heating conductor, which is ideally to be as long and thin as possible, to offer a high electrical resistance, a high heat resistance, and a large radiating area. Long freestanding heating conductors have the disadvantage, however, that they expand in an absolute manner more under thermal load than short ones. They are thus less mechanically stable than short heating conductors.

Thermal infrared radiation sources are primarily used in nondispersive infrared (NDIR) gas analysis. NDIR gas analysis is an optical method for determining the concentration of gases. The infrared radiation of the thermal emitter radiates through the cuvette having the fluid to be measured and is then incident on the sensitive area of the detector. To focus the highest possible share of the emitted infrared radiation of the radiation source onto the detector element, an additional optical unit is frequently integrated into the beam path. The radiating heating conductor therefore always has to be kept in the same position in relation to the optical unit at operating temperature, so that the focusing on the detector element is maintained. A further requirement for heating conductors is therefore mechanical stability. Typical heating conductor materials, for example, metals, expand under thermal load, which results in deformations in conjunction with the fastening thereof, for example, on the housing of the infrared radiator. The deformation is primarily dependent in this case on the temperature, the material used, and the heating conductor geometry.

Four different types of thermal infrared radiation sources have been used in applications up to this point in gas analysis: filament lamps, resistance coils, globars, and thin-film radiators.

Radiators having resistance coils and thin-film radiators are most frequently used in compact infrared-spectroscopy devices. In spite of the high emissivity thereof, globars are not suitable for use in compact infrared-spectroscopy devices, since they usually have to be operated with water cooling and may not be electrically modulated because of the large thermal mass thereof (DE 10 2012103 662 B3). Filament lamps, for example, incandescent lamps having tungsten coils, also do have a very high radiant power, since the temperature of the tungsten coils can be up to 3000° C. However, for this purpose they have to be operated in a protective gas atmosphere or in vacuum, for example, in a glass bulb. The glass is no longer sufficiently transparent for infrared radiation above 4.5 μm wavelength, however, so that this greatly restricts the field of use.

Radiators having resistance coils made of a thin, usually meandering structured metal heating conductor foil, for example, Kanthal or nickel-chromium (U.S. Pat. No. 5,939,726 A), display a broadband infrared spectrum. The radiating element is formed freestanding in this case and is fastened on several housing points, which hold the element in a fixed position and ensure the electrical contact. However, these radiators have the disadvantage that the radiating element has an excessively low electrical resistance because of its short length. Furthermore, the low heat resistance coupled to the low electrical resistance has the result that a majority of the electrical power is dissipated in the form of heat to the housing and is not emitted as desired thermal radiation. One advantage of this structure is the mechanical stability of the radiating element under temperature load, which results from the short heating conductor length. Furthermore, the radiation emitted on both sides can be used by a reflector integrated into the radiator housing.

The spiral heating conductors proposed in Ott, T., et al: Efficient thermal infrared emitter with high radiant power, J. Sens. Sens. Syst., 4, 313-319, doi:10.5194/jsss-4-313-2015, 2015 offer a sufficiently high electrical resistance and a homogeneous temperature distribution over the entire radiating area. The thickness thereof is in the range of several micrometers. These heating conductors are embodied as freestanding, so that the lower and upper sides of the radiating element can be used with a corresponding reflector installed into the housing. However, this heating conductor geometry has the disadvantage of the mechanical instability under thermal load resulting from the unsupported, i.e., freestanding long conductor length, which results in deformations of the radiating element under high temperatures.

In the case of thin-film radiators, for example, as known from DE 102004046705 A1, the radiator element is not formed freestanding, but rather is applied to a thin, nonconductive membrane. The lower side of the heating conductor layer thus cannot be used as a radiating area. Since the heating conductor metallization can be vapor-deposited in very thin form on the membrane, a high electrical resistance of the heating conductor results. In addition, the heating conductor is always held in one position and is thus mechanically dimensionally stable. Since the heat metallization and the nonconductive membrane consist of different materials, they expand differently under thermal load. The material which expands less strongly (generally the membrane), then obstructs the thermal expansion of the heat metallization. Since the radiators are generally operated pulsed, a compression of the heat metallization thus occurs cyclically, which results in cracks and decisively reduces the service life. The membrane radiators are thus limited in the operating temperature thereof, whereby they have a low radiant power. To produce the thin-film radiator, the radiating element consisting of a thin membrane and a heat metallization has to be fastened on a support frame, to be able to fasten it in the housing of the radiation source. This frame cannot be used as a radiating area and thus prevents the optimum utilization of the available installation space as a radiating area. A further disadvantage of thin-film radiators is the inhomogeneous throughheating (hotspot in the membrane center) of the heat metallization, since it is connected by the membrane directly to the heatsink (support frame), and heat is thus always dissipated.

Presently, there is no technical solution for an infrared radiation source having freestanding heating conductor, which operates energy efficiently due to a high electrical and thermal resistance and is distinguished by a high radiant power having long-term stability, which is ensured by a heating conductor, which only deforms slightly under thermal load and has a large radiating area having the most homogeneous possible temperature distribution.

It is therefore the object of the invention to specify a heating conductor geometry which avoids the above-mentioned disadvantages and may be integrated into compact infrared-spectroscopy devices.

SUMMARY OF THE INVENTION

The object is achieved by a micro-heating conductor in that the micro-heating conductor comprises at least two heating conductor structures, wherein the heating conductor structures are arranged adjacent to one another, wherein a surface normal of one heating conductor structure plane of a first heating conductor structure encloses an angle $\alpha$ with a surface normal of a second heating conductor structure plane of a second heating conductor structure and at least two meandering protrusions of the first heating conductor structure are formed connected and electrically interconnected with at least two meandering protrusions of the second heating conductor structure, wherein the micro-heating conductor has a homogeneous thickness. In this case, the micro-heating conductor is suitable and provided for use as a radiation source, in particular as an infrared radiation source. A heating conductor structure plane is understood as a plane in which the heating conductor structure lies, i.e., the plane is spanned by the heating conductor structure. In the case of two heating conductor structures arranged adjacent to one another, the surface normals of the heating conductor structure planes which are spanned by the respective heating conductor structures enclose an angle α. A schematic sketch is shown in FIG. 2. A meandering protrusion is understood with reference to the subject matter of the present invention as a part of a pattern extending in a longitudinal direction or a curve and continuing (schematic sketch in FIG. 1). In this case, adjacent protrusions, i.e., protrusions in succession in the sequence of the pattern, face away from one another in opposite directions. To enhance the mechanical stability of the micro-heating conductor for the application in radiation sources, it is necessary for at least two meandering protrusions of two adjacent heating conductor structures to be connected to one another. However, more than two or all meandering protrusions which are opposite to one another when two heating conductor structures are arranged adjacent to one another can also be connected to one another. A micro-heating conductor thus results which is composed of heating conductor structures which are electrically interconnected with one another, if the connections are formed electrically conductive. The thickness of the micro-heating conductor is understood as the material thickness of the heating conductor, which is multiple times less than the dimensions of the heating conductor structure. It is less than 5 μm.

In one special embodiment of the micro-heating conductor according to the invention, a temperature greater than 700 K is achievable using the micro-heating conductor. This is essential for the use of the micro-heating conductor according to the invention as a radiation source, since the micro-heating conductor can first be used as a radiation source in the infrared spectral range at these temperatures.

To achieve a high radiant power, in addition to a high temperature, the radiating area has to be as large as possible. For a high efficiency, the electrical resistance and the heat resistance have to be high, so that as little heat as possible can drain off via the electrical terminals.

This is provided by the heating conductor structure according to the invention, which enables the advantage of a particularly homogeneous temperature distribution in conjunction with the homogeneous heating conductor thickness.

To achieve these properties of the micro-heating conductor, the heating conductor structure has a structure width <500 μm, preferably <250 μm, still more preferably <125 μm. This means the conductor structure widths are greater by approximately two orders of magnitude than the thickness of the heating conductor material. The mechanical stability in the event of thermal strain may also be significantly enhanced at temperatures >700 K by the meandering heating conductor structures and the connection of the opposing meandering protrusions.

In one special embodiment of the subject matter according to the invention, the meandering protrusions of two adjacent heating conductor structures are mechanically, thermally, and electrically connected. The connection between two meandering protrusions is formed such that the protrusions are connected in one region or the protrusions partially overlap. It has to be ensured at least that a heat flow can flow through the respective connection, to be able to heat the micro-heating conductor uniformly over the heating conductor structures. The connection can also be formed as an adhesive bond or a welded bond. It is important that the connection acts both mechanically, thermally, and also electrically, i.e., the mechanical connection ensures the mechanical stability of the micro-heating conductor, the thermal connection is the foundation for the homogeneous throughheating of the micro-heating conductor, so that homogeneous infrared emission can be achieved, wherein the electrical connection ensures the electric current flow, using which the micro-heating conductor is heated according to the principle of Joule heating.

The meandering protrusions are formed curved or n-polygonal, wherein n is a natural number greater than two. If the shape of a meandering protrusion is locally changed, its partial resistance rises or sinks, which has the result that a higher or lower current density, respectively, is present at this point, whereby the local temperature can be increased or decreased. It is therefore possible to set the temperature distribution as desired in the entire heating conductor. It is therefore also possible to find a shape for each of the individual meandering protrusions, which in total cause a homogeneous throughheating of the radiating area of the heating conductor. Furthermore, the electrical resistance of the heating conductor structures and the mechanical stability of the micro-heating conductor in a radiation source can thus also be influenced and set. A partial resistance is understood as the electrical or thermal resistance, respectively, of a meandering protrusion. N-polygonal means in this case that the openings, for example, in a metal foil have the shape of a triangle (with n=3) or a rectangle (with n=4), etc.

In a further embodiment of the subject matter according to the invention, the angle α of the surface normals of the heating conductor structure planes of two adjacent heating conductor structures has a dimension of −90° to +90°, preferably −30° to +30°. An angle of +90° results if two heating conductor structure planes are at a right angle in relation to one another, i.e., the surface normals of the planes enclose an angle of 90° and are oriented toward one another. An angle of −90° results if the surface normals of the heating conductor structure planes enclose an angle of 90° but are oriented away from one another. With respect to the present subject matter according to the invention, the angle α can thus assume all values between +90° and −90°, including the range limits (+/−90°). The advantage of tilting adjacent heating conductor structures is that such structures have a higher stability than planar structures. This also applies to the preferred range of −30° to +30°, wherein the stability of the structures is enhanced still further in this case.

In one preferred embodiment, the surface normals of two adjacent heating conductor structures are formed extending parallel to one another. This means that the enclosed angle α is zero. The heating conductor structures are located in one plane, but the heating conductor structures do not overlap.

In a further embodiment, the micro-heating conductor is formed from one material. This means the heating conductor structures are made of the same material and can either be joined to form one micro-heating conductor or the micro-heating conductor is produced as a result of structuring of a material, for example, a metal foil, by introducing openings into the material. The size of these openings is advantageously less than 50 μm.

In one preferred embodiment of the micro-heating conductor, the material for this heating conductor is formed from a nickel-based alloy, from a nickel-based super alloy, from a NixCr1-x alloy having $0 \leq x \leq 1$, from tungsten, from molybdenum, from carbon, from platinum, from tantalum, from vanadium, from a titanium-based alloy, from rhenium, from niobium, from cobalt, or from an alloy of at least two of these materials. The list is to be understood as an or-linkage, wherein an alloy consists of at least two of these listed materials.

In one embodiment of the invention, an equal current density can be formed in the semiconductor structures. If a voltage is applied to the micro-heating conductor, a current flows through the micro-heating conductor consisting of heating conductor structures. Heat is generated because of the electrical resistance of the heating conductor structures, which works against the current flow. The current density is dependent on the current strength and the cross-sectional area available to a current, through which the current passes perpendicularly. If the geometry of the heating conductor structures is selected so that the same current density is present everywhere, the radiating area of the micro-heating conductor is homogeneously heated and the risk of local melting of the heating conductor and thus the destruction of the radiation source formed therefrom because of overheating can be avoided. In combination with the mechanical connections between the individual heating conductor structures, a homogeneous radiator having optimized mechanical stability is thus implementable.

In one embodiment of the subject matter according to the invention, the heating conductor structures are formed free-standing. This has the advantage that both the front and also the rear side of the micro-heating conductor are available for thermal radiation emission. The risk of deformation thus also rises, however, and the stability of the structures, the dimensions of which are in the micrometer range, is reduced. Because of the above-described mechanical connections between the meandering protrusions between adjacent heating conductor structures, however, this disadvantage can be remedied.

In another embodiment, the heating conductor structures are formed on a membrane. The membrane has to be a non-conductor, for example, silicon dioxide. The disadvantage of the inhomogeneous throughheating of the radiating element of thin-film radiators because of the direct connection of heatsink (support frame) and heat metallization can be remedied by the variation of the shape of the openings formed by the meandering protrusions. The partial resistance of the individual meandering sections is decisive.

In a further embodiment, the micro-heating conductor is formed from at least two heating conductor structures, which are formed so that the micro-heating conductor forms a round or elliptical heating conductor area in the heating conductor structure plane. FIG. 8 shows a schematic illustration. This is particularly advantageous if the micro-heating conductor is installed in a round housing, since the installation space can be optimally used with this structural form and the emitting area can be selected as particularly large.

In another further embodiment, the micro-heating conductor is formed from at least two heating conductor structures, which are formed so that the micro-heating conductor forms a bulging heating conductor surface. The heating conductor surface then no longer lies in one plane but rather bulges, similarly to a segment on a spherical surface. The bulging surface acts as a type of collimator having a focal point. This can be used to focus the emitted radiation and thus increase the radiation density.

In one particularly advantageous embodiment, the micro-heating conductor is used as a radiation source.

The invention will be explained in greater detail hereafter on the basis of exemplary embodiments.

BRIEF DESCRIPTION OF THE DRAWING FIGURES

DETAILED DESCRIPTION

Figure 1:
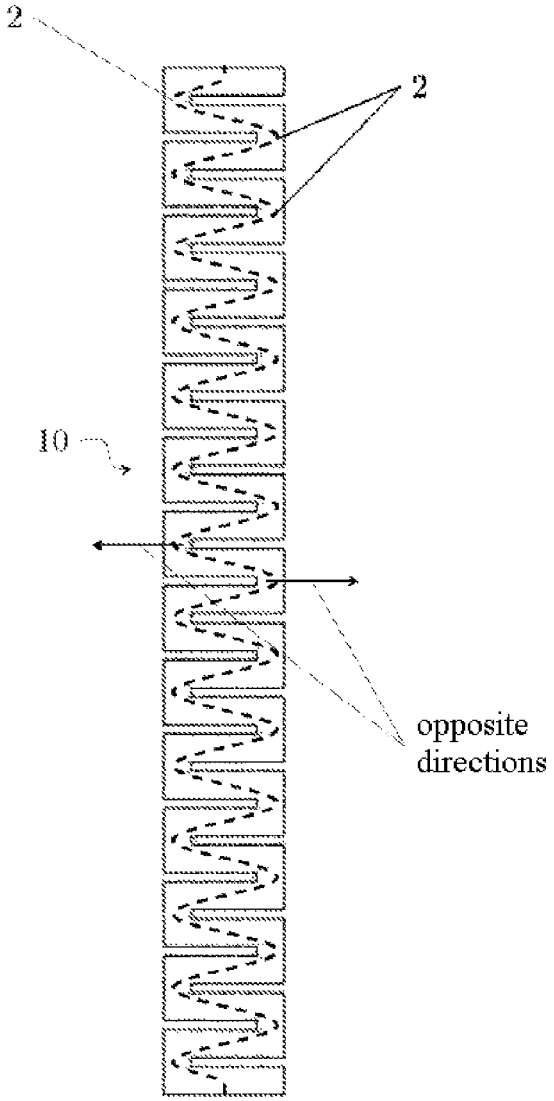
FIG. 1 shows a schematic sketch of a meandering heating conductor structure according to the prior art.

FIG. 1 shows the schematic illustration of a meandering heating conductor structure 10. A meander is a pattern continuing in one direction and repeating, wherein a meandering protrusion 2 is understood with reference to the subject matter of the present invention as a part of this pattern and adjacent protrusions 2, i.e., protrusions 2 in succession in the sequence of the pattern, face away from one another in opposite directions.

Figure 2:
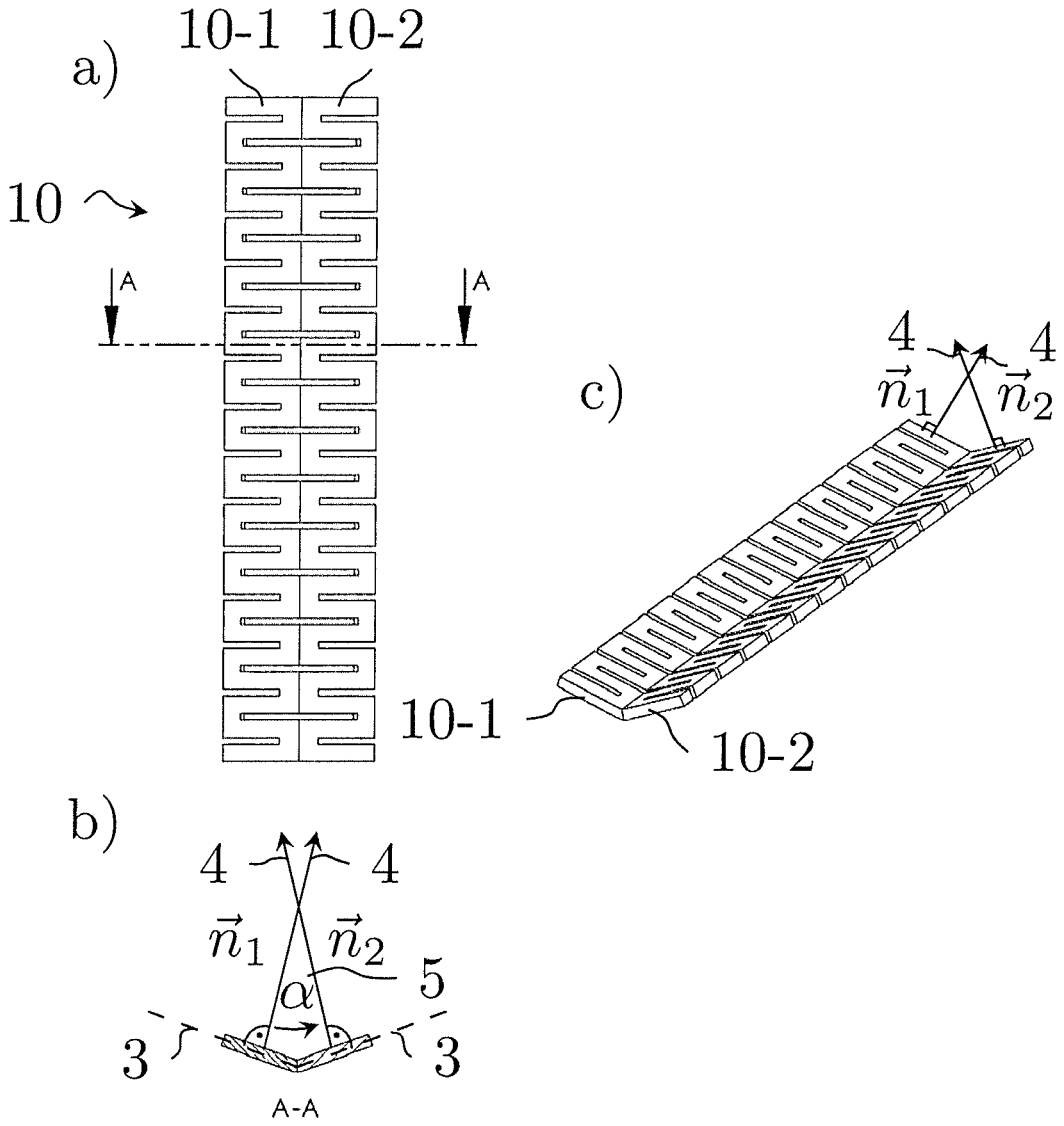
FIG. 2 shows micro-heating conductors according to the invention consisting of two heating conductor structures: a) top view, b) tilting, c) perspective view.

FIG. 2 shows the combination of two meandering heating conductor structures 10-1, 10-2, wherein a heating conductor structure 10 spans a heating conductor structure plane 3 with a surface normal 4 and two adjacent heating conductor structures 10-1, 10-2 can be formed tilted in relation to one another (FIG. 2*b*) at an angle 5. FIG. 2*c*) shows a perspective illustration of two adjacent heating conductor structures, which are formed tilted in relation to one another. In the illustration of FIG. 2, all meandering protrusions 2 of the first heating conductor structure 10-1 are connected to the meandering protrusions 2 of the second heating conductor structure 10-2. The advantage of both this connection and also the tilting is higher mechanical stability.

Figure 3:
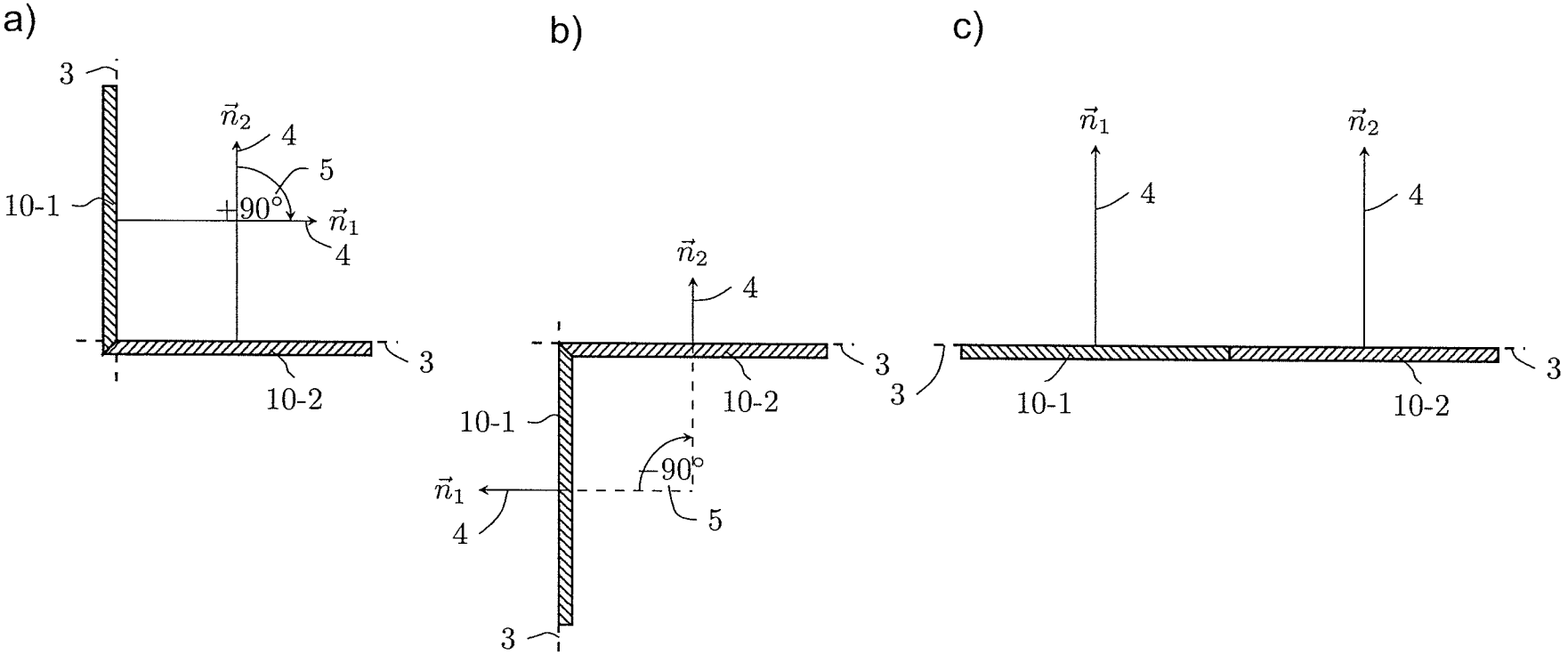
FIG. 3 shows tilting of two adjacent heating conductor structures.

FIG. 3 shows the tilting of two adjacent heating conductor structures 10-1, 10-2 in relation to one another. In this case, in FIG. 3*a*), the surface normals 4 of the heating conductor structure planes 3 of the heating conductor structures 10-1 and 10-2 enclose an angle α of +90°, since the surface normals 4 are oriented toward one another, while in contrast the surface normals 4 of the heating conductor structure planes 3 of the heating conductor structures 10-1 and 10-2 in FIG. 3*b*) are oriented away from one another and thus enclose an angle α of −90°. In FIG. 3*c*), the surface normals 4 of the heating conductor structure planes 3 of the heating conductor structures 10-1 and 10-2 extend in parallel, i.e., the planes 3 again lie in one plane and thus span a level, planar micro-heating conductor 1.

Figure 4:
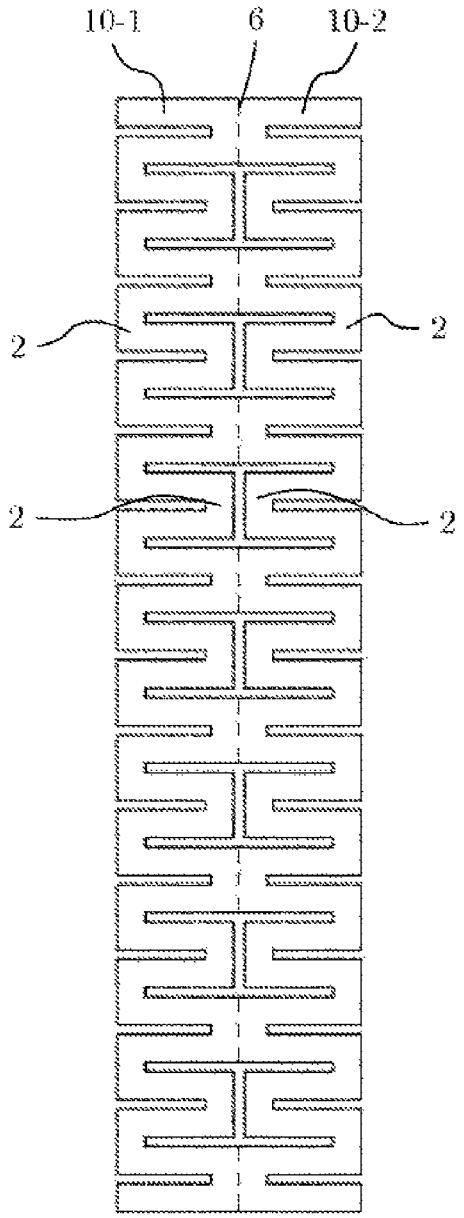
FIG. 4 shows a micro-heating conductor according to the invention consisting of two heating conductor structures—meandering protrusions of the first heating conductor structure are not all connected to the meandering protrusions of the second heating conductor structure.

Two heating conductor structures 10-1, 10-2 connected to one another are also shown in FIG. 4, however, not all meandering protrusions 2 of the first heating conductor structure 10-1 are connected to the meandering protrusions 2 of the second heating conductor structure 10-2. This impairs the mechanical stability only insignificantly or not at all.

Figure 5:
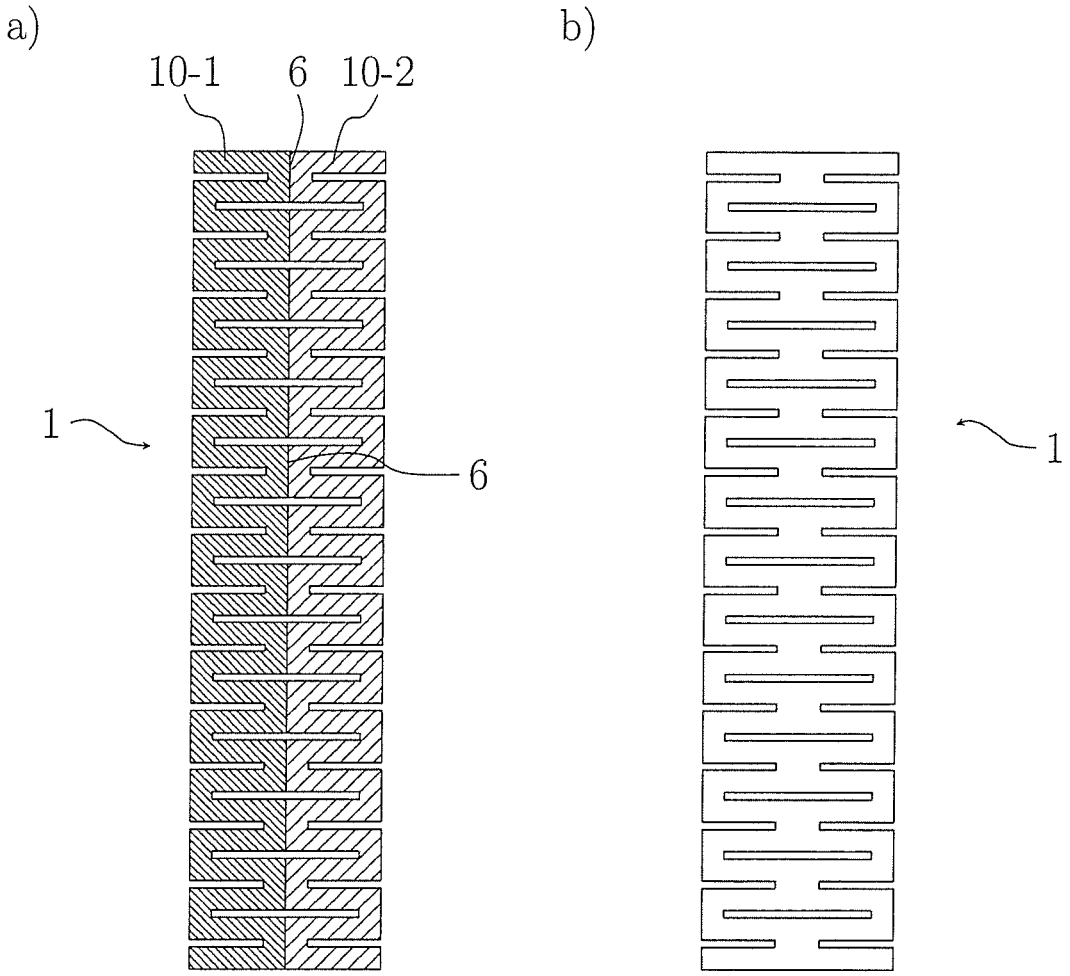
FIG. 5 shows a micro-heating conductor according to the invention consisting of two heating conductor structures: a) shaded first and second heating conductor structures, b) without shading.

FIG. 5 shows an embodiment of the micro-heating conductor 1 according to the invention in which two heating conductor structures 10-1, 10-2 are arranged in one plane, so that the surface normals 4 of the heating conductor structure planes 3 extend in parallel to one another (see also FIG. 3*c*)). The meandering protrusions 2 of the first heating conductor structure 10-1 are connected in this case to the respective opposing meandering protrusions 2 of the second heating conductor structure 10-2, which face in the opposite direction to the meandering protrusions 2 of the first heating conductor structure 10-1. The mechanical stability can thus be substantially enhanced in relation to a single freestanding heating conductor structure 10 having dimensions in the micrometer range.

Figure 6:
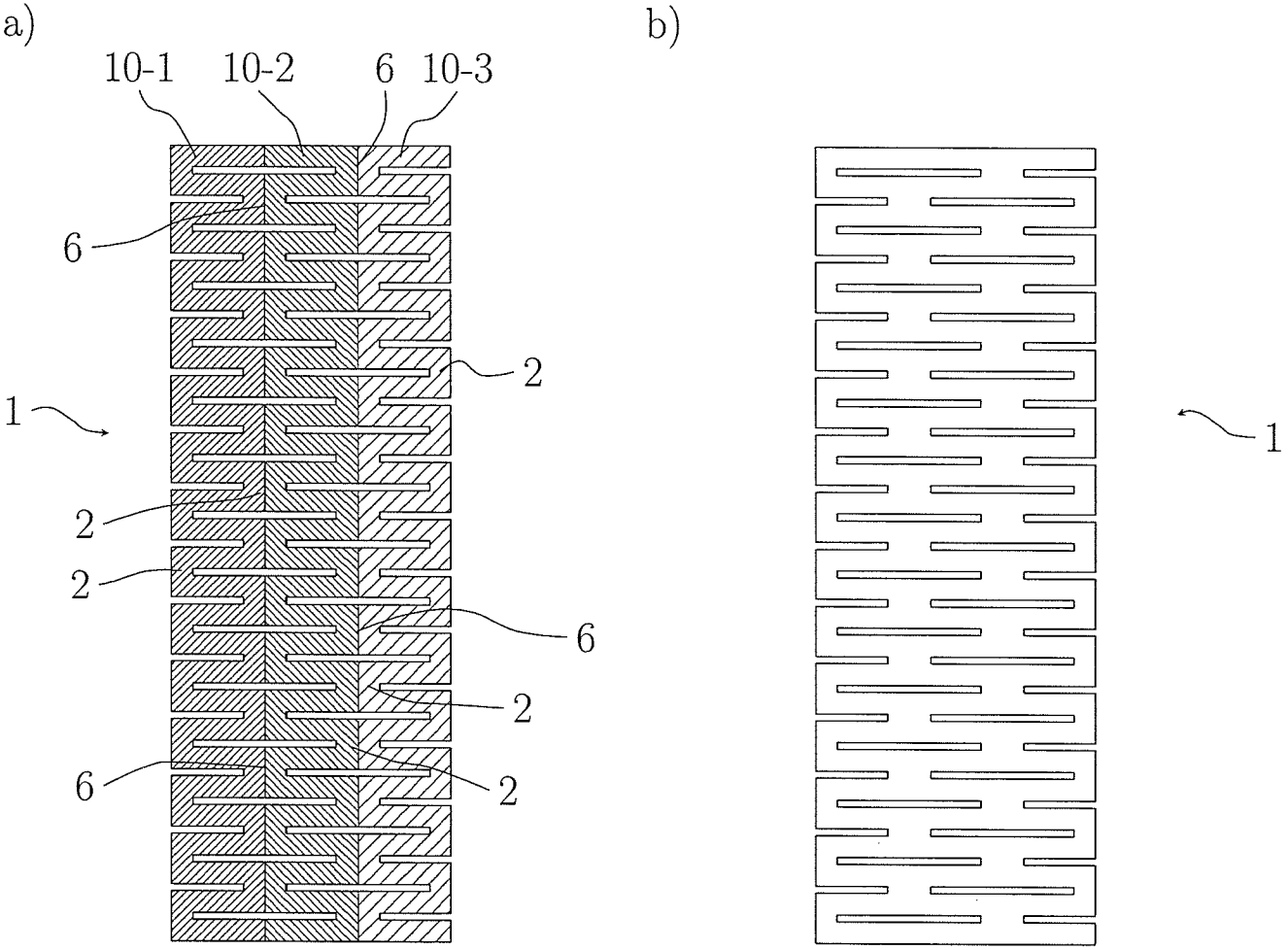
FIG. 6 shows micro-heating conductors according to the invention consisting of three heating conductor structures: a) shaded first, second, and third heating conductor structures, b) without shading.

FIG. 6 shows an embodiment of the micro-heating conductor 1 according to the invention, in which three heating conductor structures 10-1, 10-2, 10-3 are arranged in one plane, so that the surface normals 4 of the heating conductor structure planes 3 extend in parallel to one another. The meandering protrusions 2 of the first heating conductor structure 10-1 are connected in this case to the respective opposing meandering protrusions 2 of the second heating conductor structure 10-2, which face in the opposite direction to the meandering protrusions 2 of the first heating conductor structure 10-1. The meandering protrusions 2 of the second heating conductor structure 10-2 are accordingly connected 6 to the respective opposing meandering protrusions 2 of the third heating conductor structure 10-3, which face in the opposite direction to the meandering protrusions 2 of the second heating conductor structure 10-2. In comparison to the micro-heating conductor made of two meanders or heating conductor structures (FIG. 5), with equal heating conductor area, the mechanical stability of the heating conductor is enhanced by more connection points, wherein the electrical resistance is only slightly lowered.

Figure 7:
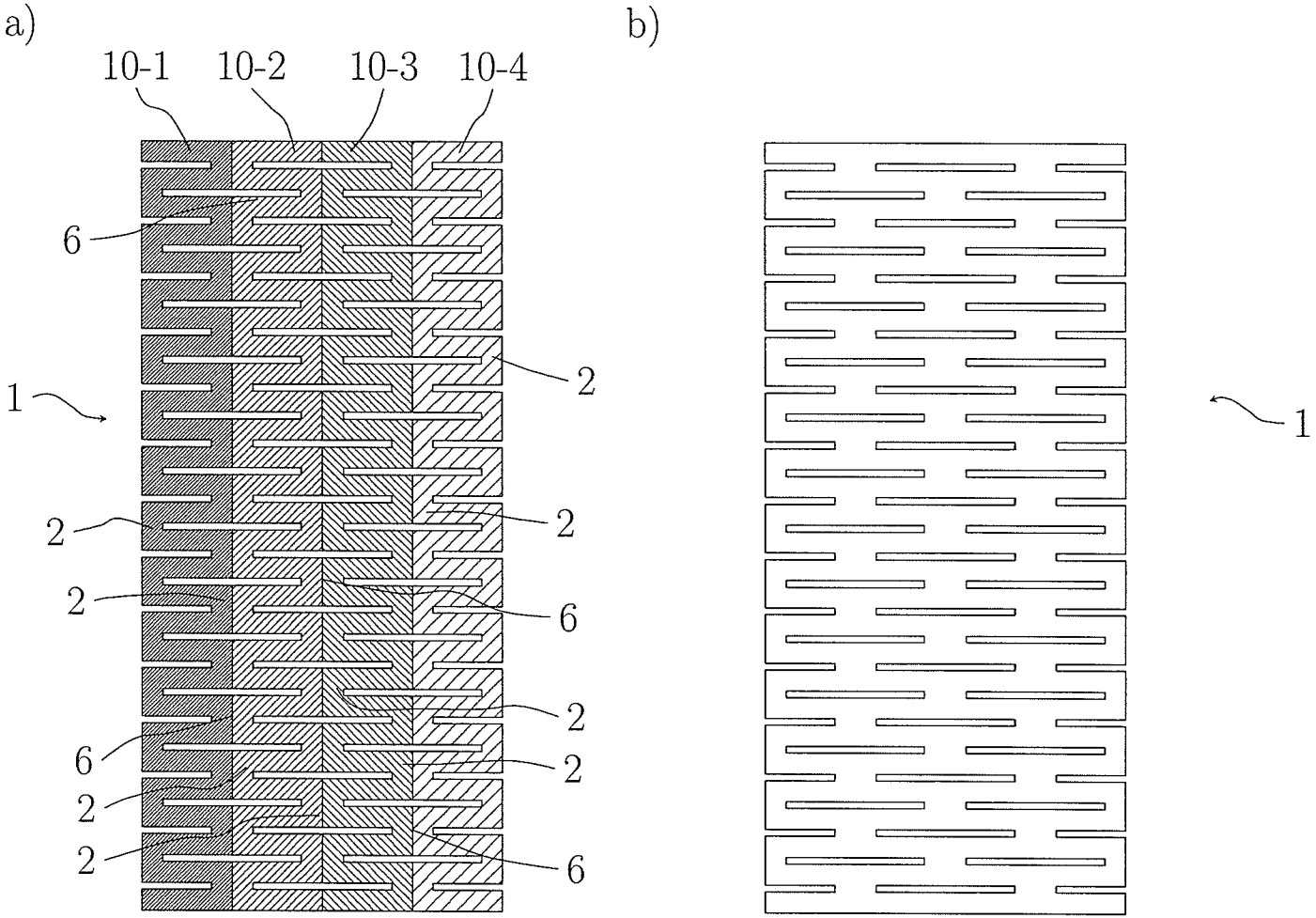
FIG. 7 shows micro-heating conductors according to the invention consisting of four heating conductor structures: a) shaded first to fourth heating conductor structures, b) without shading.

FIG. 7 shows an embodiment of the micro-heating conductor 1 according to the invention, in which four heating conductor structures 10-1, 10-2, 10-3, 10-4 are arranged in one plane, so that the surface normals 4 of the heating conductor structure planes 3 extend in parallel to one another. The meandering protrusions 2 of the first heating conductor structure 10-1 are connected 6 in this case to the respective opposing meandering protrusions 2 of the second heating conductor structure 10-2, which face in the opposite direction to the meandering protrusions 2 of the first heating conductor structure 10-1. The meandering protrusions 2 of the second heating conductor structure 10-2 are accordingly connected 6 to the respective opposing meandering protrusions 2 of the third heating conductor structure 10-3, which face in the opposite direction to the meandering protrusions 2 of the second heating conductor structure 10-2. The arrangement applies accordingly to the combination with the fourth heating conductor structure 10-4. In this embodiment, the mechanical stability of the heating conductor structure 1 is further enhanced by many connection points.

Figure 8:
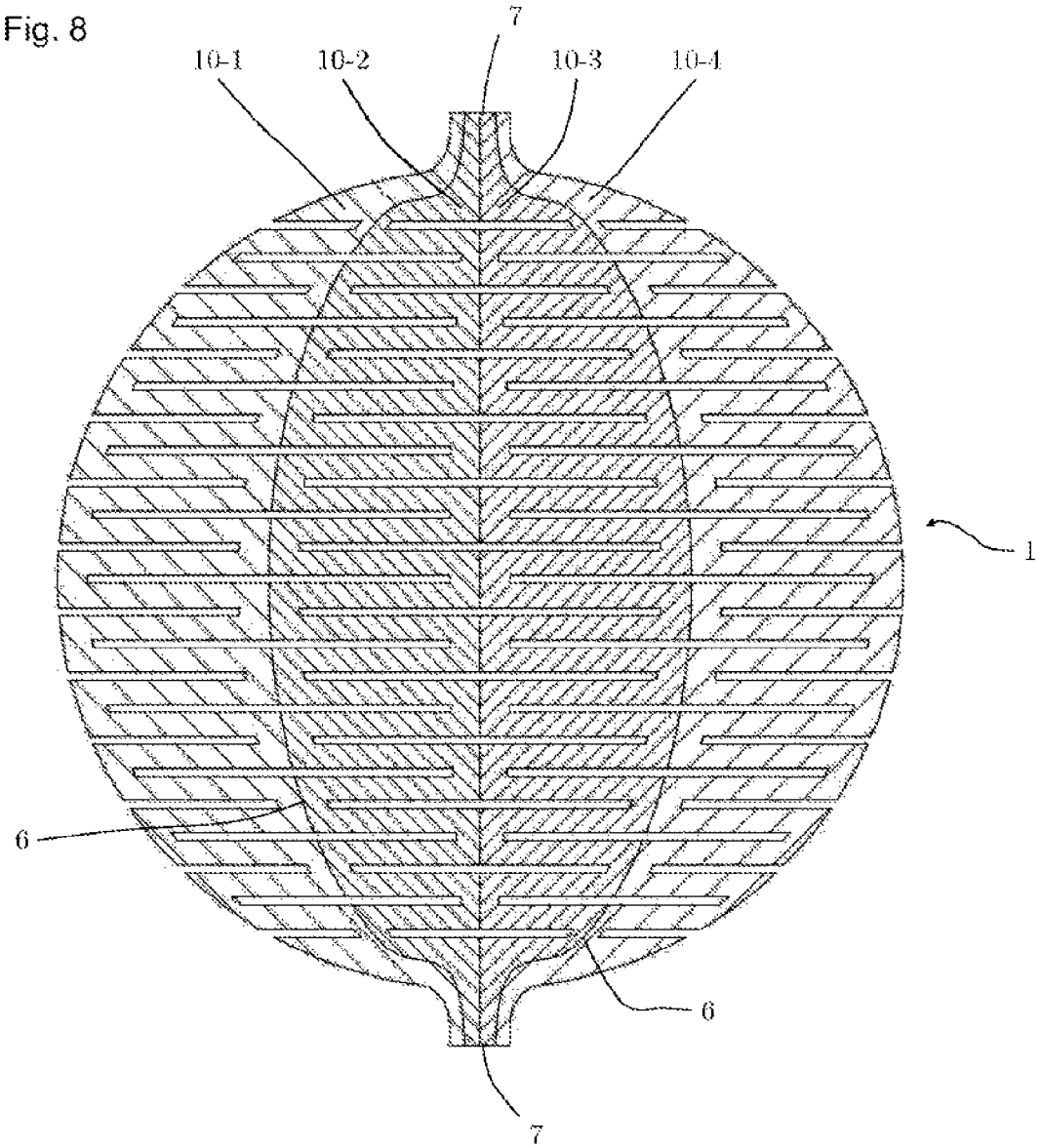
FIG. 8 shows micro-heating conductors according to the invention consisting of four heating conductor structures, wherein the heating conductor structures are formed curved and thus form a round or elliptical radiant surface.

A further embodiment of the micro-heating conductor 1 according to the invention is shown in FIG. 8. If the micro-heating conductor 1 is installed in a housing 11, i.e., used as a radiation element in a radiation source, for example, an infrared radiation source, the structure of the micro-heating conductor 1 can then advantageously be adapted to the embodiment of the installation space of the radiation source housing 11. As shown in FIG. 8, the micro-heating conductor 1 having the heating conductor structures 10 can be formed round in the case of a round configuration, so that the micro-heating conductor 1 can be optimally utilized by this arrangement, i.e., the maximum possible radiating area can be introduced into the round housing 11.

Figure 9:
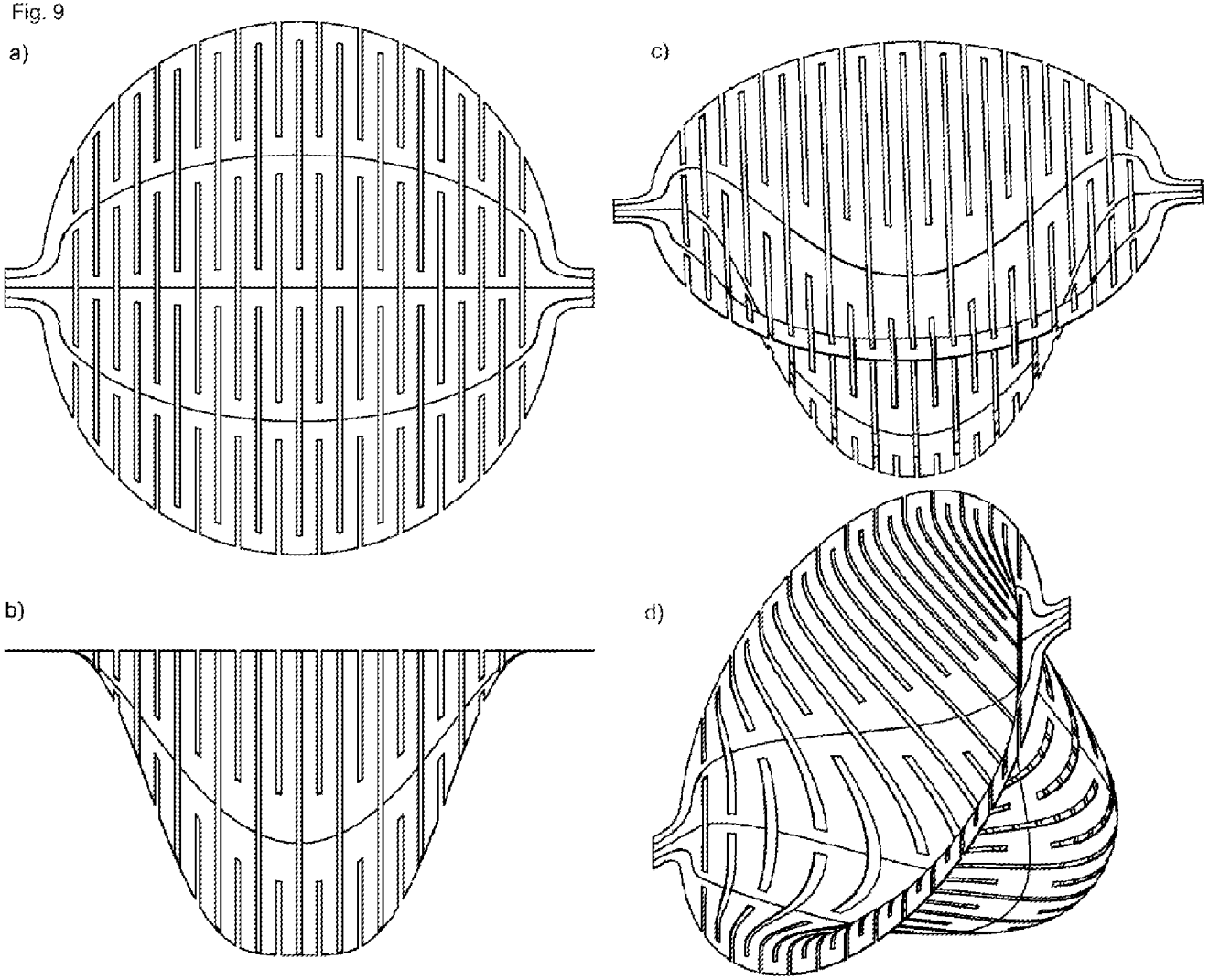
FIG. 9 shows micro-heating conductors according to the invention consisting of four heating conductor structures, wherein the heating conductor structures are formed bulging and thus form a type of collimator having focal point, a) top view, b) side view, c) and d) different perspective views.

A further embodiment of the micro-heating conductor 1 according to the invention is shown in FIG. 9. If the micro-heating conductor 1 is installed in a housing 11, i.e., used as a radiation element in a radiation source, for example, an infrared radiation source, the structure of the micro-heating conductor 1 can then advantageously be adapted to the embodiment of the installation space of the radiation source housing 11. This round configuration can advantageously also be formed bulging at the same time. This can be used, for example, for focusing the radiation and increasing the radiation density. FIG. 9 *a*) shows a top view, *b*) shows a side view, and FIGS. 9 *c*) and *d*) show different perspective views of the bulging micro-heating conductor 1 consisting of four heating conductor structures 10.

Figure 10:
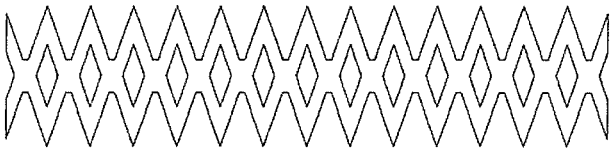
FIG. 10 shows micro-heating conductors according to the invention having curved or n-polygonal meandering protrusions: a) triangular (n=3), b) curved.
Figure 10:
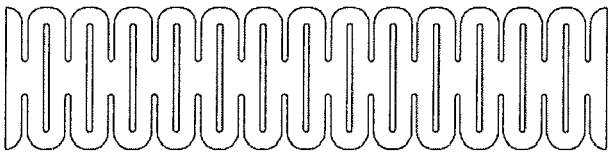

FIG. 10 shows various shapes of the meandering structures 2 or protrusions. FIG. 9*a*) shows the shape of the meandering protrusions with n=3, i.e., the meanders have the shape of triangles, and in FIG. 9*b*), the meandering structures 2 are formed curved. Depending on the heat profile to be formed, i.e., local setting of the current density and thus the throughheating, various meandering structure shapes 2 can also be combined with one another.

Figure 11:
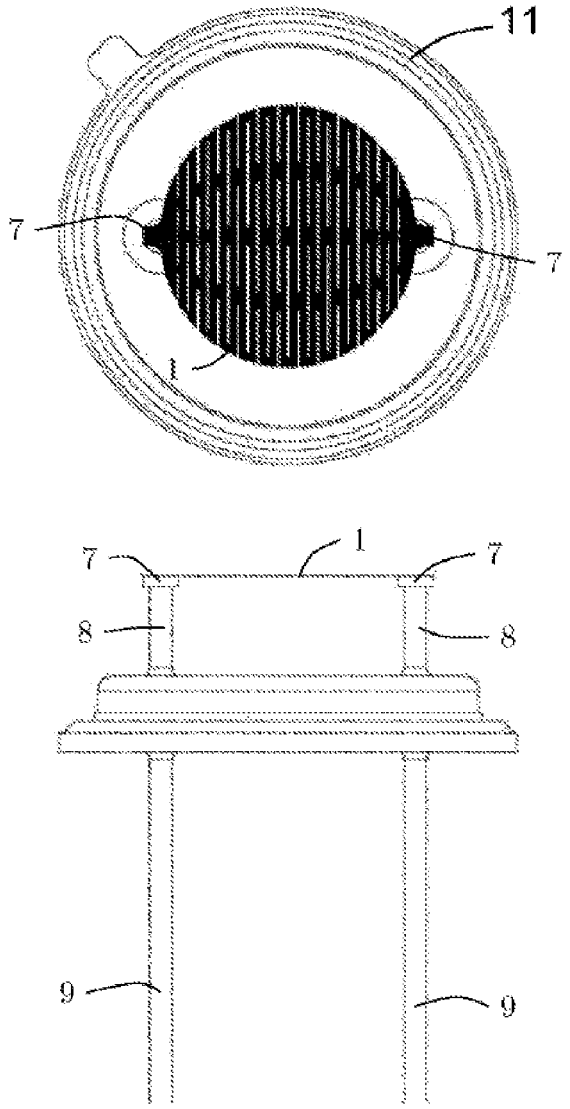
FIG. 11 shows micro-heating conductors according to the invention installed in a housing for use as an infrared radiation source.

FIG. 11 shows the use of the micro-heating conductor 1 according to the invention as a radiation source in a housing 11. The micro-heating conductor 1 is contacted via the two contacts 7 of the micro-heating conductor 1 with the corresponding inner terminals 8 in the housing 11, wherein the radiation source and thus the micro-heating conductor 1 are operated via the outer terminals 9.

LIST OF REFERENCE SIGNS

1 micro-heating conductor
10 heating conductor structure
10-1 first heating conductor structure
10-2 second heating conductor structure
10-3 third heating conductor structure
**10-*n*** nth heating conductor structure
2 meandering protrusion
3 heating conductor structure plane
4 surface normal
5 angle between two surface normals
6 connection between two meandering protrusions
7 terminals of the heating conductor structure for the installation in a radiation source
8 inner housing terminals
9 outer housing terminals
11 housing for the micro-heating conductor

The invention claimed is:

1. A heating conductor for a radiation source, wherein the heating conductor is formed from a meandering heating conductor structure, which has meandering protrusions and spans a heating conductor structure plane with a surface normal, wherein adjacent meandering protrusions are formed in the heating conductor structure plane and each pair of adjacent protrusions are electrically interconnected solely in series at one end of each of the adjacent protrusions to form a plurality of electrically interconnected ends, characterized in that the heating conductor comprises at least a first and a second heating conductor structure, wherein the first and second heating conductor structures are arranged adjacent to one another such that electrically interconnected ends of the first heating conductor structure are positioned adjacent electrically interconnected ends of the second heating conductor structure, wherein a surface normal of a heating conductor structure plane of the first heating conductor structure encloses an angle with a surface normal of a second heating conductor structure plane of the second heating conductor structure and at least two meandering protrusions of the first heating conductor structure are electrically interconnected with at least two meandering protrusions of the second heating conductor structure, wherein the heating conductor has a homogeneous thickness, wherein the angle enhances mechanical stability.

2. The heating conductor for a radiation source as claimed in claim 1, wherein a temperature greater than 700 K is achievable using the heating conductor.

3. The heating conductor for a radiation source as claimed in claim 1, wherein the heating conductor structure has a width less than 500 μm.

4. The heating conductor for a radiation source as claimed in claim 1, wherein the meandering protrusions of two adjacent heating conductor structures are mechanically, thermally, and electrically connected.

5. The heating conductor for a radiation source as claimed in claim 1, wherein the meandering protrusions are formed curved or n-polygonal, wherein n is a natural number greater than two.

6. The heating conductor for a radiation source as claimed in claim 1, wherein the angle $\alpha$ of the surface normals of two adjacent heating conductor structures has a dimension of −90° to +90°, preferably −30° to +30°.

7. The heating conductor for a radiation source as claimed in claim 1, wherein the surface normals of two adjacent heating conductor structures are formed extending in parallel to one another.

8. The heating conductor for a radiation source as claimed in claim 1, wherein the heating conductor is formed from one material.

9. The heating conductor for a radiation source as claimed in claim 8, wherein the material is formed from a nickel-based alloy, from a nickel-based super alloy, from a $Ni_xCr_{1-x}$ alloy having $0 \leq x \leq 1$, from tungsten, from molybdenum, from carbon, from platinum, from tantalum, from vanadium, from a titanium-based alloy, from rhenium, from niobium, from cobalt, or from an alloy of at least two of these materials.

10. The heating conductor for a radiation source as claimed in claim 1, wherein an equal current density is formed in the heating conductor structures.

11. The heating conductor for a radiation source as claimed in claim 1, wherein the heating conductor structures are formed freestanding.

12. The heating conductor for a radiation source as claimed in claim 1, wherein the heating conductor structures are formed on a membrane.

13. The heating conductor for a radiation source as claimed in claim 1, wherein the heating conductor is formed from at least two heating conductor structures, which are formed so that the heating conductor forms a round or elliptical heating conductor area in the heating conductor structure plane.

14. The heating conductor for a radiation source as claimed in claim 1, wherein the heating conductor is formed from at least two heating conductor structures, which are formed so that the heating conductor forms a bulging heating conductor area.

15. The heating conductor for a radiation source as claimed in claim 1, wherein the heating conductor is used as a radiation source.

16. The heating conductor for a radiation source as claimed in claim 4, wherein the meandering protrusions are formed curved or n-polygonal, wherein n is a natural number greater than two.

17. The heating conductor for a radiation source as claimed in claim 16, wherein the surface normals of two adjacent heating conductor structures are formed extending in parallel to one another.

18. The heating conductor for a radiation source as claimed in claim 17, wherein the material is formed from a nickel-based alloy, from a nickel-based super alloy, from a $Ni_xCr_{1-x}$ alloy having $0 \leq x \leq 1$, from tungsten, from molybdenum, from carbon, from platinum, from tantalum, from vanadium, from a titanium-based alloy, from rhenium, from niobium, from cobalt, or from an alloy of at least two of these materials.

19. The heating conductor for a radiation source as claimed in claim 18, wherein the heating conductor structures are formed on a membrane.

20. The heating conductor for a radiation source as claimed in claim 19, wherein the heating conductor is formed from at least two heating conductor structures, which are formed so that the heating conductor forms a bulging heating conductor area.

21. The heating conductor for a radiation source as claimed in claim 1, wherein the angle is a tilting angle and wherein the tilting angle enhances mechanical stability and increases radiation density.

* * * * *